United States Patent [19]

Beine

[11] 4,052,833

[45] Oct. 11, 1977

[54] TRACK ASSEMBLY WITH ANCHORING DEVICE

[76] Inventor: Karlheinz Beine, Am Ehrkamper Bruch 9, 4030 Ratingen, Germany

[21] Appl. No.: 723,282

[22] Filed: Sept. 14, 1976

[30] Foreign Application Priority Data

July 13, 1976 Germany ..... 2631396

[51] Int. Cl.[2] ..... E04B 1/38; E04C 5/00

[52] U.S. Cl. ..... 52/710; 52/334; 52/721; 403/284

[58] Field of Search ..... 52/710, 37, 334, 721, 52/723

[56] References Cited

U.S. PATENT DOCUMENTS

| | | | |
|---|---|---|---|
| 827,613 | 7/1906 | Brown | 52/710 X |
| 950,771 | 3/1910 | Lohmann | 52/710 |
| 992,877 | 5/1911 | Kahn | 52/710X |
| 1,035,525 | 8/1912 | Bright | 52/710 X |
| 1,314,854 | 9/1919 | Cain | 52/710 |
| 1,502,766 | 7/1924 | Curley | 52/710 X |
| 1,556,607 | 10/1925 | Kane | 52/710 |
| 1,561,126 | 11/1925 | Timm | 52/710 X |
| 1,581,262 | 4/1926 | Zabriskie | 52/710 X |
| 2,676,680 | 4/1954 | Kindorf | 52/710 X |
| 2,784,812 | 3/1957 | Kindorf | 52/710 X |

FOREIGN PATENT DOCUMENTS

| | | | |
|---|---|---|---|
| 537,066 | 4/1950 | Canada | 52/710 |
| 645,666 | 7/1928 | France | 52/710 |

*Primary Examiner*—Ernest R. Purser
*Assistant Examiner*—Robert C. Farber
*Attorney, Agent, or Firm*—Bacon & Thomas

[57] ABSTRACT

Disclosed is a track assembly, particularly adapted for embedding in a structural component, comprising a track member having a rear wall with at least one attachment aperture therein and a back surface adapted for abuttng against the structural component, at least one anchor lug extending from the back surface, the anchor lug having an extension which passes through the attachment aperture in the rear wall of the track member, the anchor lug being secured to the track member by a swaged deformation of the extension on at least one side of the rear wall.

13 Claims, 6 Drawing Figures

TRACK ASSEMBLY WITH ANCHORING DEVICE

BACKGROUND OF THE INVENTION

1. Field of the Invention

The present invention relates to structural accessories for the attachment of elements to structural components, and in particular to tie tracks and the like which are designed for permanent attachment to a wall, or a ceiling, or some other structural component by means of anchoring elements attached to the tie track.

2. Description of the Prior Art

Several types of tie tracks of the type mentioned are known from the prior art. In one such prior art version, the anchor lugs are constituted by rearwardly extending leg portions of U-shaped anchor elements, formed from flat stock and inserted through appropriate stamped slots in the rear wall of the track profile. A major disadvantage of this prior art design is the fact that the connection between the anchor elements and the track profile is not a rigid one, so that the tie track can become loose.

Also known is a prior art track where the the anchor lugs are welded to the back side of the track profile. This version has the disadvantage that, under the influence of the welding heat, the profile of the tie track may become distorted and that stress concentrations may be created which reduce the overall resistance of the tie track, especially in the area surrounding the attachment weld of the anchor lug.

SUMMARY OF THE INVENTION

Underlying the present invention is the objective of devising an improved tie track with inset anchor lugs extending from its back side, where the anchor lugs are rigidly and securely attached to the track profile, without the need for special attachment means, and without unduly reducing the resistance of the tie track profile in the area surrounding the anchor lug attachment points.

The present invention proposes to attain this objective by suggesting a novel tie track with inset anchor lugs which are attached to the track profile by means of a shaft portion on each anchor lug which reaches through a matching aperture in the back wall of the track profile and which is swaged against that wall to form a rigid connection therewith.

The suggested solution has the advantage that the anchor lugs are firmly and rigidly attached to the track profile, using a minimum of space for the attachment, and holding to a minimum the weakening of the track profile, so as to offer adequate resistance for all practical uses.

By way of a preferred embodiment of the invention, it is further suggested that the apertures for the anchor lugs be rectangular in outline and longitudinally aligned in a row and that the area surrounding each aperture be depressed rearwardly in relation to the back wall of the track profile. In this manner, it is possible to accommodate the swaged head of the anchor lug inside the track profile, without substantially reducing the free cross section of the latter, as the swaged heat substantially disappears in the depressed portion of the rear wall.

The preferred embodiment of the invention is further characterized in that the anchor lugs have abutment flanges on their shaft portions which limit the depth of insertion of the anchor lugs into the attachment apertures. The same abutment flanges also conveniently serve as supporting flanges in the swaging operation. In the preferred case of a rectangular aperture and a matching rectangular shaft portion of the anchor lug, the abutment flanges take the form of laterally extending longitudinal ribs, similar to the flanges of an I-profile.

In one version of the preferred embodiment of the invention, the abutment flanges engage the back wall of the track profile from the rear, while a shaft extension reaches inwardly through the attachment aperture. Once inserted, the anchor lug is permanently attached to the track profile by swaging the inwardly protruding portion of the shaft extension into the space of the depression surrounding the attachment aperture.

The result is a tight and rigid connection between the anchor log and the track profile, with the abutment flanges engaging the back wall surrounding the attachment aperture from the outside and the swag heat engaging the same wall portions from the inside. The connection thus obtained is highly resistant and remains rigid, even under extreme loads.

The fact that the back wall of the track profile has a rearward depression around the attachment aperture results in an outwardly inclined wall portion around the attachment aperture. To take advantage of this shape, the swaging tools are so designed that the — initially flat — abutment flanges of the anchor lugs are reshaped to conform with the inclined wall portion of the track profile, thereby further solidifying the swaged connection.

In a second version of the preferred embodiment of the invention, the anchor lugs have lterally enlarged shaft extensions terminating in lateral end flanges. The appropriately enlarged attachment apertures in the back wall of the track profile are then large enough to allow for the insertion of the anchor lugs through the track opening and through the attachment aperture, so that the abutment flanges engage the back wall from the inside. In this case, the enlarged shaft extension is of such a height that a portion thereof reaches rearwardly a distance beyond the surface of the back wall, forming a shoulder in relation to the remaining shaft portion of the anchor lug.

Following insertion of the anchor lug from the inside of the tie track profile, the swaging operation is performed by supporting the end flange through the track profile and by engaging the earlier-mentioned shoulders with appropriate swaging tools which, when actuated, shorten the anchor lug towards the rear wall of the tie track, thereby forming swaged flanges on both sides of the anchor lug surrounding the attachment aperture, in opposition to the end flanges on the inner extremity of the anchor lug. The latter is again of such a shape that it substantially disappears in the depression surrounding the attachment aperture.

BRIEF DESCRIPTION OF THE DRAWINGS

Further special features and advantages of the invention will become apparent from the description following below, when taken together with the accompanying drawings which illustrate, by way of example, preferred embodiments of the invention, represented in the various figures as follows.

DESCRIPTION OF THE PREFERRED EMBODIMENT

Figure 1:
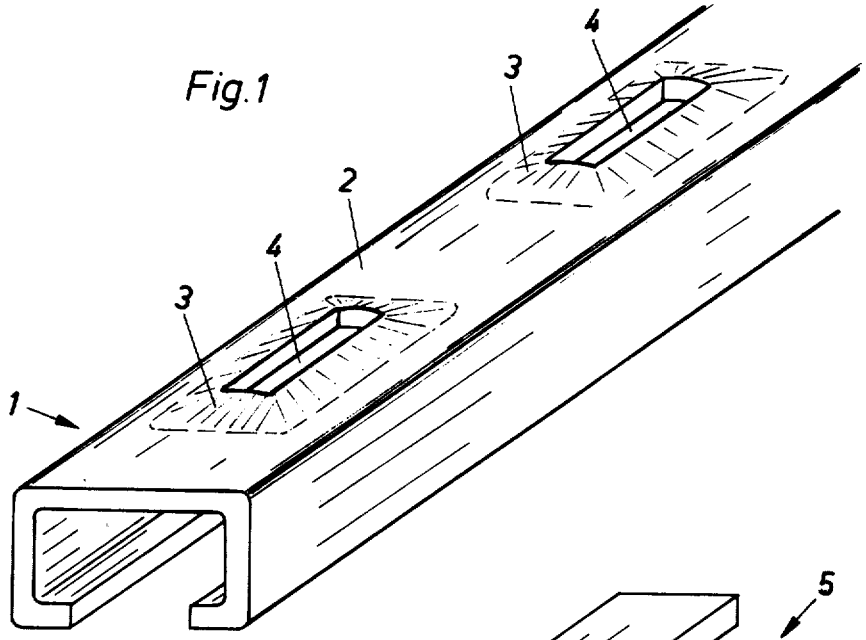
FIG. 1 is a perspective view of a tie track profile, before attachment of the anchor lugs.
Figure 2:
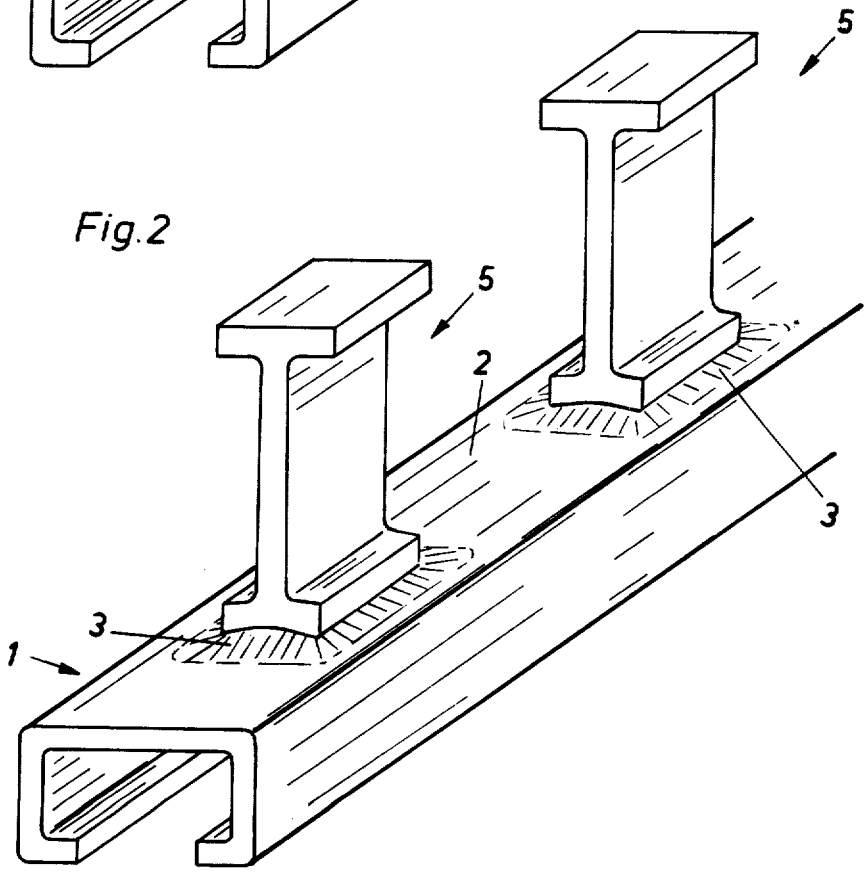
FIG. 2 shows the tie track profile of FIG. 1 with appropriate anchor lugs attached thereto.

Referring to FIG. 1 and FIG. 2, there is illustrated a tie track 1 having the shape of a continuous C-shaped profile. In the back wall 2 of the track profile are arranged, at regular longitudinal intervals, rearwardly bulging depressions 2, obtained in a stamping operation. In the center of each depression 3 is arranged an attachment aperture 4 of generally rectangular outline, the apertures 4 being longitudinally aligned in a regular row. It should be understood that the attachment apertures 4, shown to be rectangular, could also be of some other convenient shape, such as oval or round. They need not be longitudinally aligned, but may also be oriented transversely.

Figure 3:
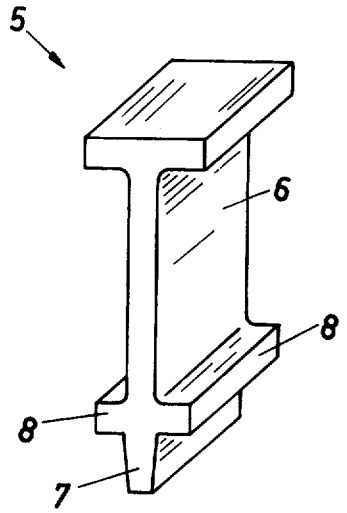
FIG. 3 shows one version of an anchor lug, ready for attachment.

In FIG. 2 are shown anchor lugs 5 which have been inserted into the attachment apertures 4 of the track profile 1. The shape of an anchor lug before attachment is illustrated in FIG. 3. There, it can be seen that the anchor lug 5 is a short length of a regular profile resembling a I-profile with a "spike" extending from its lower flange. The "spike" is a shaft extension 7 whose cross sectional outline corresponds to the outline of the attachment aperture 4 in the back wall 2 of the tie track 1. Actually, the shape of the shaft extension 7 is preferably tapered, thereby facilitating the insertion of the anchor lug into its aperture and allowing for the arrangement of an interference fit in the fully inserted position. The inserted position is determined by the engagement of the lateral flanges 8 against the outer side of the depression 3 surrounding the attachment aperture 4.

Figure 4:
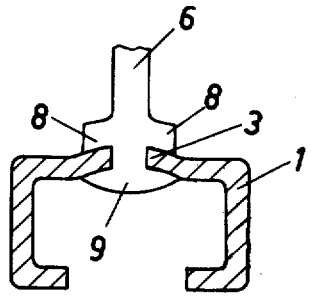
FIG. 4 shows a cross section through the tie track with an attached anchor lug of the type shown in FIG. 3.

Fully inserted, a portion of the shaft extension 7 protrudes inwardly from the back wall 2. In a swaging operation, this protruding portion is then flattened against the depressed portion of the back wall 2, so as to form a head 9, as is shown in FIG. 4. The fact that the swaged head 9 substantially disappears in the depression 3 assures that the inner space of the tie track 1 remains substantially unobstructed by the presence of the anchor lug. As can readily be seen in FIG. 4, the lateral flanges 8 of the shaft portion 6 of the anchor lug and the lateral portions of the swaged head 9 engage the wall adjacent to the attachment aperture 4 from opposite sides, thereby forming a rigid and highly resistant permanent connection between the tie track profile and the anchor lug 5.

As FIG. 4 further indicates, the wall portion of the depression 3 surrounding the attachment aperture 4 is somewhat inclined, due to the curvature of the samped depression 3. Using swaging tools supporting the lateral flanges 8 with inclined supporting faces, the resultant deformation of the flanges 8 is such that they become likewise inclined in conformance with the orientation of the wall portion around the aperture 4, thereby further improving the swaged connection.

Figure 5:
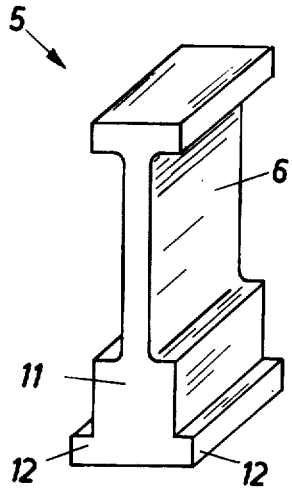
FIG. 5 shows a second version of an anchor lug, ready for attachment.

In FIG. 5 is illustrated a modified anchor lug 5 whose shape again resembles that of a short length of an I-profile. However, the lower extremity of the shaft portion 6 is inverted, as compared to the "spike" shape of the previously described anchor lug. Accordingly, the shaft portion 6 continues in a laterally enlarged shaft extension 11, and terminates in lateral end flanges 12.

This anchor lug shape is designed for insertion of the lug from the front side of the tie track profile, through the track opening 10 and through the attachment aperture 4 which, accordingly, has a width corresponding to the width of the enlarged shaft extension 11. This relationship is illustrated in FIG. 6.

Following insertion of the anchor lug 5 through the attachment aperture 4, to the point where the lateral flanges 12 abut against the inside of the depression 3, the anchor lug is again subjected to a swaging operation. For this purpose, the enlarged shaft extension 11 has such a height that a portion of it protrudes from the rear side of the attachment aperture 4, forming lateral shoulders against the narrower shaft portion 6.

Figure 6:
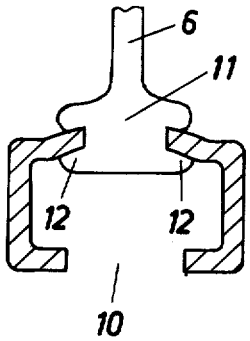
FIG. 6 shows a cross section of a tie track with an attached anchor lug of the type shown in FIG. 5.

With the anchor lug 5 fully inserted into the attachment aperture 4, the swaging operation is performed by supporting the inserted lug by its end flanges 12 and by engaging appropriate swaging tools against the earlier mentioned shoulders, flattening the latter and shortening the protruding portion of the anchor lug in the manner illustrated in FIG. 6. The mating wall portions of the track profile 2 and the flange portions created by the swaging operation are again slightly inclined. As in the previously described example, the major portion of the end flanges 12 is again received inside the depression 3 surrounding the attachment aperture 4.

The lateral flanks of the enlarged shaft extension 11 are preferably tapered, in order to facilitate the insertion of the anchoring lugs into their apertures. This assembly operation can be further improved by providing appropriate serrations on the inclined flank portions engaging the side walls of the attachment apertures, so that an interference fit is obtainable, in spite of coarse stamping tolerances of the apertures. The anchor lugs are then preferably inserted with a simple hammer blow.

It should be understood, of course, that the foregoing disclosure describes only a preferred embodiment of the invention and that it is intended to cover all changes and modifications of this example of the invention which fall within the scope of the impended claims.

What is claimed is:

1. A track assembly of the type which is adapted to be permanently anchored to a concrete structural member by being at least partially embedded therein, the assembly comprising:
   - a track member in the form of a continuous structural shape having, as part of said shape, a rear wall defining a track member positioning outer surface and an oppositely facing inner surface;
   - a row of attachment apertures extending through the rear wall of the track member; and
   - a row of anchor lugs attached to the track member, at its attachment apertures; and wherein
   - the anchor lugs have shaft portions extending rearwardly away from the track member and attachment portions with which they reach through their associated attachment apertures; and
   - the attachment portions of the anchor lugs include integral laterally upset portions with which they engage the rear wall area surrounding their attachment apertures in a longitudinally and transversely preloaded rivet-like rigid clamping engagement.

2. A track assembly as defined in claim 1, wherein the attachment portion of an anchor lug is defined by one extremity of the anchor lug.

3. A track assembly as defined in claim 1, wherein an anchor lug includes, as part of its attachment portion, a generally inwardly facing abutment shoulder with which it bears against the outer surface of the rear wall of the track member, and a generally outwardly facing abutment shoulder with which it bears against the inner surface of said wall; and at least one of said shoulders is a part of said integral laterally upset portions.

4. A track assembly as defined in claim 3, wherein the attachment portion of the anchor lug is formed by the inner end portion of the latter;

the attachment portion of the anchor lug includes: a lateral flange forming said inwardly facing abutment shoulder, a narrower extension reaching inwardly from said shoulder through the associated attachment aperture, and a head portion formed on the inner extremity of the extension after its incertion through the aperture, the head portion forming said outwardly facing abutment shoulder and being a part of said intregral laterally upset portions.

5. A track assembly as defined in claim 3, wherein the attachment portion of the anchor lug includes: a lateral flange forming said outwardly facing abutment shoulder, a narrower shaft portion on the outer side of said shoulder extending through the associated attachment aperture, and a lateral protrusion formed on said shaft portion, after its insertion through the aperture, the lateral protrusion forming said inwardly facing abutment shoulder and being a part of said integral laterally upset portions.

6. A track assembly as defined in claim 1, wherein the track member is a continuous channel in the shape of a "C," said channel having a substantially flat back forming said rear wall with the attachment apertures, and an open front giving access to said apertures; and the rear wall includes rearward depressions in the area surrounding each attachment aperture.

7. A track assembly as defined in claim 6, wherein the attachment apertures are elongated, generally rectangular openings in the rear wall of the channel, in alignment with the axis of the latter; and the attachment portions of the anchor lugs have attachment portions engaging said opening with a profile of matching rectantular cross section.

8. For assembly into a tie track which is to be anhored in a concrete structural member by at least parial embedding therein, a track member in the form of a ontinuous structural shape and a plurality of malleable nchor lugs which include:

a rear wall as part of said structural shape forming the track member;

a row of attachment apertures cut into said rear wall; and an attachment portion on each anchor lug which includes an insertion portion adapted for insertion into one of said attachment apertures, and an abutment shoulder determining the depth of insertion, so that the insertion portion protrudes a short distance to the other side of the rear wall, where it can be upset into a clamping engagement with the aperture-surrounding rear wall at assembly.

9. The track member and anchor lugs as defined in claim 8, wherein the insertion portions of the anchor lugs are tapered, for initial insertion into the attachment apertures with clearance; and the maximum thickness of the insertion portions produces a press fit with an attachment aperture, when fully inserted.

10. The track member and anchor lugs as defined in claim 8, wherein the insertion portions of the anchor lugs have surface serrations, which, after forcible engagement of an anchor lug into an attachment aperture, produce a press fit.

11. The track member and anchor lugs as defined in claim 8, wherein the attachment apertures in the track member rear wall are elongated, generally rectangular openings;

the anchor lugs are cut lengths of a structural shape, corresponding in length to the length of an attachment aperture;

the profile of said structural shape, in the sense in which it is cut, includes an elongated shaft portion with a laterally protruding anchoring flange on one end, and an attachment profile on the other end serving as said attachment portion of the anchor lug; and the attachment profile includes, as said insertion portion, an insertion profile fitting into the attachment aperture, and, forming said abutment shoulder, opposite lateral flange profiles adjoining the insertion profile on one end thereof.

12. The track member and anchor lugs as defined in claim 11, wherein the attachment profile of the anchor lugs has its lateral flange profiles located at its junction with the shaft portion.

13. The track member and anchor lugs as defined in claim 11, wherein the attachment profile of the anchor lugs has its lateral flange profiles located at its extremity opposite its junction with the shaft portion; and the insertion profile is wider than the shaft portion.

* * * * *